US009682471B2

(12) United States Patent
Jacobson et al.

(10) Patent No.: US 9,682,471 B2
(45) Date of Patent: Jun. 20, 2017

(54) MODULAR TOOL HOLDER

(71) Applicants: Jack M. Jacobson, Walla Walla, WA (US); Jeffrey D. Jacobson, Seattle, WA (US)

(72) Inventors: Jack M. Jacobson, Walla Walla, WA (US); Jeffrey D. Jacobson, Seattle, WA (US)

(73) Assignee: TrueCast Designs LLC, Seattle ( * ) Notice: Subject to any disclaimer, the term of this patent is extended or adjusted under 35 U.S.C. 154(b) by 0 days.

(21) Appl. No.: 15/057,110

(22) Filed: Feb. 29, 2016

(65) Prior Publication Data

US 2016/0279786 A1 Sep. 29, 2016

Related U.S. Application Data

(63) Continuation of application No. 14/055,879, filed on Oct. 16, 2013, now abandoned.

(60) Provisional application No. 61/795,460, filed on Oct. 17, 2012, provisional application No. 61/853,627, filed on Apr. 9, 2013, provisional application No. 61/854,838, filed on May 2, 2013.

(51) Int. Cl.

| | |
|---|---|
| ***B25H 3/00*** | (2006.01) |
| ***A46B 17/02*** | (2006.01) |
| ***B44D 3/12*** | (2006.01) |
| ***B65D 1/12*** | (2006.01) |
| ***B65D 25/04*** | (2006.01) |
| ***B65D 25/32*** | (2006.01) |

(52) U.S. Cl.

CPC ..... *B25H 3/00* (2013.01); *A46B 17/02* (2013.01); *B44D 3/123* (2013.01); *B65D 1/12* (2013.01); *B65D 25/04* (2013.01); *B65D 25/32* (2013.01)

(58) Field of Classification Search

CPC . B25H 3/00; B25H 3/04; B65D 25/22; B65D 5/4208; B44D 3/128

USPC ..... 206/361, 349, 373, 372, 362, 15.2, 806; 220/751, 735, 736; 211/70.6

See application file for complete search history.

(56) References Cited

U.S. PATENT DOCUMENTS

| | | | | |
|---|---|---|---|---|
| 4,867,332 A * | 9/1989 | Mains | B25H 3/04 | 206/372 |
| 5,181,297 A * | 1/1993 | Andrews, Jr. et al. | B65D 67/02 | 220/23.4 |
| 5,261,561 A * | 11/1993 | Hodges, Jr. | B65D 25/00 | 206/315.11 |
| 5,881,891 A * | 3/1999 | Murphy, Jr. | A47L 13/51 | 211/65 |
| 7,290,651 B2 * | 11/2007 | Irwin | A47L 13/51 | 206/216 |
| 2006/0144732 A1 * | 7/2006 | Kaplan | B25H 3/00 | 206/349 |

* cited by examiner

*Primary Examiner* — Steven A. Reynolds
(74) *Attorney, Agent, or Firm* — Patrick M Dwyer

(57) ABSTRACT

A tool caddy with vertical inner and outer compartment support sections. The inner and outer sections are made of a semi-rigid, semi-flexible material such as thermoplastic and joined to each other at their respective upper ends by a saddle. The support sections are generally pre-formed to fit the tapering radius of a selectable container and each support section has at least one compartment.

17 Claims, 4 Drawing Sheets

MODULAR TOOL HOLDER

CROSS REFERENCE TO RELATED APPLICATIONS

This application is a Continuation of U.S. patent application Ser. No. 14/055,879 filed Oct. 16, 2013 which claimed priority to the following three U.S. Provisional Patent applications: 61/795,460 filed Oct. 17, 2012; 61/853,627 filed Apr. 9, 2013; and 61/854,838 filed May 2, 2013, all of which are hereby incorporated by this reference as if fully set forth herein.

TECHNICAL FIELD

This disclosure relates to tool holders and tool organizers; more particularly it relates to a modular tool holder or caddy and a brush holder for use with a bucket-type container that has a handle.

BACKGROUND

Tool holders that attach to conventional plastic buckets and other like containers, including common five-gallon utility buckets, are well known and popular in the marketplace. Professional tradespeople and homeowners alike purchase and use tool holders for buckets to conveniently carry, organize, and store their tools.

Existing tool holders for conventional plastic buckets fall into two main categories: fabric or leather tool holders and plastic tool holders. Fabric tool holders typically provide a multitude of pockets for carrying various sizes of tools and hardware. They wrap around the outside of a bucket, providing storage capacity on the bucket's exterior, or they drape over the rim of a bucket and provide storage capacity on the bucket's exterior and interior. Plastic tool holders typically take the form of: 1) inserts that fit inside a bucket; or 2) clip-on devices that attach to the rim of the bucket.

Conventional fabric and leather tool organizers are difficult to clean if they become soiled, are subject to wear, cuts, and tears, that impact storage capacity and durability, are not well suited to prolonged exposure to moisture and climatic extremes, or to chemicals and other substances that are associated with many tasks undertaken by tradespeople, homeowners, and hobbyists, including painting, masonry, gardening, fishing, and many other activities. They are not designed for easy removal from a bucket and they do not function well independent of a bucket. They may become ungainly and difficult to carry when loaded, with tools stored in the exterior pockets dangling outward and prone to unwanted contact with walls, doorways, and other surfaces, as well as potentially injurious contact with the person carrying the bucket.

Conventional plastic tool organizer inserts provide no storage capacity on the bucket's exterior. They provide a top-down only view of stored contents, which can obscure tools or hardware as they are needed and prove inconvenient to use, particularly systems that use stackable trays.

Conventional plastic tool holders that clip on the rim of a bucket typically attach high on a bucket, with a container or containers sitting at or near the bucket rim, creating a high center of gravity that is unsuited to holding a significant quantity or variety of tools, as the weight of the tools tend to destabilize the bucket and cause it to tip over. They are typically made for a single use, such as holding a paint brush, and are not adapted for a multitude of tools. They can interfere with the movement of the bucket handle, which can hinder handle operation and compromise access to the tool holder, and they also do not function well independent of a bucket.

Each of these existing devices are limited in their usefulness in various ways. They are generally large, bulky devices and take up significant space when not in use. They also make inefficient use of space within a bucket's interior.

DISCLOSURE

A modular tool holder and organizer for use with a conventional plastic bucket and made from hard plastic material is disclosed. It includes an inner section that conforms to the inner vertical surface of the bucket, and an outer section that conforms to the outer vertical surface of the bucket. The inner and outer sections are joined and are supported by the rim of the bucket. Compartments or bins or sets of bins of various sizes are attached to the inner and outer sections of the tool holder creating storage space for a variety of tools and hardware or parts inside and outside of the bucket. The modular tool holder may be used singly on a bucket or in combination with another tool holder or with multiple tool holders on a bucket.

A tool caddy having generally vertical inner and outer compartment support sections that are pre-formed to fit the tapering radius of a selectable container such as the ubiquitous five gallon utility bucket is also disclosed. It is believed that any round, top-to-bottom tapered container, such as the five gallon bucket of the type sold in hardware stores for utility purposes will serve as the selectable container. With some modifications that will occur to those skilled in the art, it will be optional to use containers that are neither round nor tapered as well. The inner and outer support sections are advantageously neither leather nor cloth but rather some semi-rigid, semi-flexible material such as thermoplastic, or virtually any plastic suitable for injection molding. In general a material is used that is form-retaining and self-supporting, as opposed to cloth or even leather. The inner and outer sections are joined to each other at their respective upper ends by a saddle, and each support section has at least one tool compartment.

In some instances there will be only a single support section, typically an outer section, which hangs over the rim of the selectable container, leaving the interior of the container free to hold liquids, dirt or other materials. This same function can also be fulfilled by a normal outer section and a shortened inner section with no compartments. In some instances where there are both an inner and an outer support section, only one section, typically an inner section, will be pre-formed to fit the tapering radius of the selectable container.

Some sections are desirably made not of plastic but of wire, or a combination of wire and plastic. In a wire section, support is provided in some instances by two vertical wire lengths, bent at their respective tops to form two hooks which fulfill the function of the disclosed saddle. A wire support section could also be woven from wire and consist of one woven, more or less contiguous, central section (like the plastic ones) to which compartments are attached. This configuration can have either an outer section only, or an inner section only, or both inner and outer sections. Caddies can have a wire construction on one side and a plastic or other semi-rigid, semi-flexible material construction on the other side. Likewise, some compartments are formed from wire cages, and these cages can optionally be mounted on wire support sections on plastic-type support sections.

What is meant by the expression "semi-rigid, semi-flexible" is a material that is rigid enough to retain a pre-formed shape (such as by molding or stamping or pressing) but which retains a degree of flexibility so that it can be twisted and or bent enough to fit onto and off of the selectable container and any rim structure the container might have.

The inner and outer sections are joined to the saddle in any of several possible ways. The inner or outer section may be clipped or screwed to the saddle, the inner and outer sections may be formed as a single piece with the saddle, or the inner or outer sections may be glued or otherwise bonded to the saddle.

The saddle is advantageously large enough to slide over the rim of the selectable container, and has at least one guide extending into the interior of the saddle to engage the rim. The guide can be a ridge running all or part way laterally along the inside of one or both support sections, just below where the saddle engages the rim of the container. Or it can be a point or a set of points or dots or teeth or other protrusions that run all or part way laterally along the inside of one or both support sections. One kind of guide is also intended as a flexible and releasable snap locking part of the saddle that flexes slightly as the saddle is slid over the rim of the container, and then snaps back to engage a lip on the outer rim of most common containers. The guide serves to restrict motion of the caddy either up or down, or laterally along the rim. An alternative to the guide described above is to attach a soft friction material, such as chair leg bottom felt pads in place of, or in addition to, the guides disposed within the saddle. The saddle desirably has a built in handle.

Preferred tool caddies have a plurality of tool compartments removably attached to at least one of the support sections. However in some instances, it will be advantageous to have the compartments either integral to the respective support section, or permanently attached. In other instances, it will be desirably to permit the compartments to slide from one position to another, typically with a means to lock the sliding compartment into place for extended usage. Other means of removably attaching compartments to support sections will occur to those skilled in the art without departing from the scope of this disclosure.

Some of the tool compartments for the disclosed caddy have at least one tab and are removably attached to its respective support section by hooking the tab into a corresponding slot in the section. Slots in the section are also positioned advantageously to provide for receiving various lengths of belting or loop material, such as can be used to hold hammers and the like tools. Other slots are provided to receive therethrough a different kind of tab (or it may be the same tab as describe above) that has radiused upper and lower portions that serve as guides for the section to slide down over the container rim and then again up over the rim for removal of the caddy from the container. These radiused guides extend inward with respect to the outside of the various support sections, where the tabs of compartments that snap on to the support sections protrude, to permit the caddy to easily slide on and off a bucket without the protruding tabs hanging up on the rim. Such radiused guides are not needed in other applications, such as when the caddy with its tool compartments is cast in a single piece or when sonic welding or the like is used to bond the support structure and compartments together without the need for tab or other mechanical connections.

The tool caddy advantageously has at least one compartment that has a generally flat bottom. The flat-bottomed compartment is operatively engaged at a lower end of a support section so that the flat bottom serves as a base or foot for the section. Where both support sections are operably of equal length, allowing for slightly differing lengths along inside and outside dimensions of the container, and each section has a base or foot formed either by a flat-bottomed compartment, or by a different foot piece, the caddy will be stably free-standing outside of the container, even when loaded with tools. Where the support sections are not of equal length, a foot or stand-off piece can be added to the compartment or other foot of the shorter section to equalize the lengths for this purpose of free-standing tool caddy.

Though the tool caddy of this disclosure in described in many instances in reference to a general or particular container having various characteristics, it is to be understood that a free-standing tool caddy (without bucket or other container) is intended to fall within the scope of the appended claims. However it is intended also to include in the claims the combination of the disclosed tool caddy and the container itself.

In a combination bucket and tool caddy, the inner and outer sections are pre-formed respectively to inner and outer vertical surface contours of the bucket. Where there are a plurality of tool caddies or support sections on the bucket or other container, it is advantageous to include a section fastener to attach one section to another. The fastener is optionally a clip, clasp, slide, pin or the like mechanism for holding two side-by-side trays or compartments together. The use of such a fastener in this disclosure is believed to be novel, but the fastener technology itself will known to those skilled in the art.

In most instances of using a disclosed support section and its compartments, also known herein as a caddy or caddy section, in conjunction with a bucket or other suitable container, the bucket will have a wire bale handle or the like with two attachment points on either side of the bucket. Rather than have the fact of and the position of the handle and its attachment points be a problem for caddy placement and attachment within the bucket, at least some embodiments of the disclosed tool caddy are crafted to take advantage of the bucket handle.

In some embodiments, where there are at least one pair of side-by-side caddies on the bucket, there are corresponding cutaways on mating sides of the respective caddies that are formed to match the bucket's radius and taper and that are disposed to face each other closely on each side of the bucket's handle. The virtual opening that surrounds the handle attachment point thus formed acts as a kind of locking window to restrict or prevent lateral motion of the caddy pair along the rim of the bucket, and at the same time to restrict or prevent upward motion of the caddy pair as it hangs on the rim.

Caddy embodiments have the option of having a plurality of compartments removably attached to at least one of the support sections, and any caddy and its tools is desirably removable from its bucket to stand generally vertically on its own.

The disclosed modular tool holder is believed to have the following advantages over conventional tool holders:

conveniently holds a variety of tools inside and outside of a bucket within a medium that is easy to clean and highly resistant to deterioration caused by moisture, climatic variations, and exposure to corrosive substances, while providing interior and exterior containers that sit low on the bucket and are closely conformed to the interior and exterior bucket walls, lowering the center of gravity when the tool holder is loaded to enhance bucket stability;

provides sturdy compartments that can hold tools more upright, and compactly, than the pouches used in conventional tool holders;

can easily be removed from a bucket and used independently as a freestanding tool organizer, and easily reattached simply by placing the tool holder back on the bucket rim to give users the ability to carry a portion of their tools to a task without carrying the entire bucket and its contents;

permits stable and user-friendly operation of the bucket while being carried, with modular tool holders that can be placed together, along either side of the bucket where the handle joins, putting the weight of stored tools on the bucket where bucket swing can be minimized while being carried; and creates an open space on the bucket's exterior that allows the bucket to hang closer and more comfortably to a person carrying it while avoiding unwanted contact with tools being carried.

DETAILED DESCRIPTION

Figure 1:
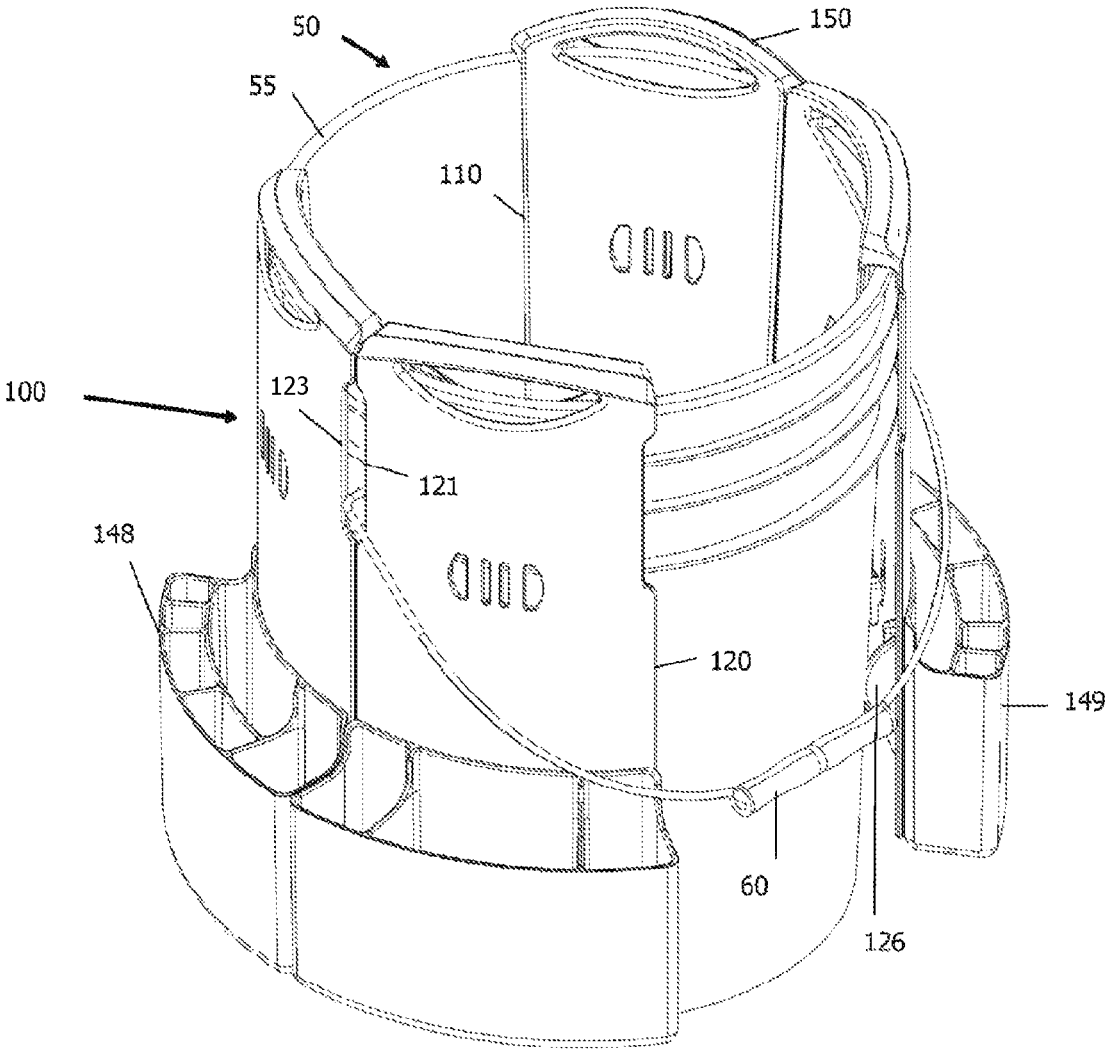
FIG. 1 is an isometric view of the modular tool holder with container

The disclosed modular tool holder has some or all of the following components:

a bent plastic form, referred to here as a saddle, either in the shape of an inverted U, or sometimes a squared off inverted U channel, with an interior void large enough to slide over the rim of a plastic bucket, and with the interior-most wall of the saddle formed to match the radius of the rim of the bucket for secure support;

the saddle with its interior and exterior support sections extends from the rim of the bucket on the inside toward the bottom of the bucket and follows the interior contour and taper of the bucket for a compact fit, and from the rim of the bucket on the outside toward the bottom of the bucket and follows the exterior contour and taper of the bucket for a compact fit;

a compartment or set of compartments with various sub compartments and dividers that attach to the inside of the interior support section, and a compartment or set of compartments with various sub compartments and dividers that attach to the outside of the exterior support section;

a built in handle to ease lifting of the tool holder on and off a bucket;

a guide or set of guides in the form of an elevated ridge or ridges extending into the interior of the saddle, where it interfaces with a bucket's exterior vertical surface, to ease the attachment or removal of a tool holder on a bucket by helping it slide over the bucket rim, and to help hold the tool holder securely to a bucket when attached;

a clip, clasp, slide, pin, or other fastener to attach one tool holder to another, if desired, when placed on a bucket, or alternately, a ridge, point, or otherwise elevated portion or portions of the interior face of the saddle, where it interfaces with the interior surface of a bucket, to create friction on the walls of the bucket to prevent the tool holder from moving or sliding when attached to a bucket.

Turning now to the drawings, the disclosed modular tool holder will be described by reference to the numerals of the drawing figures wherein like numbers indicate like parts.

Figure 2:
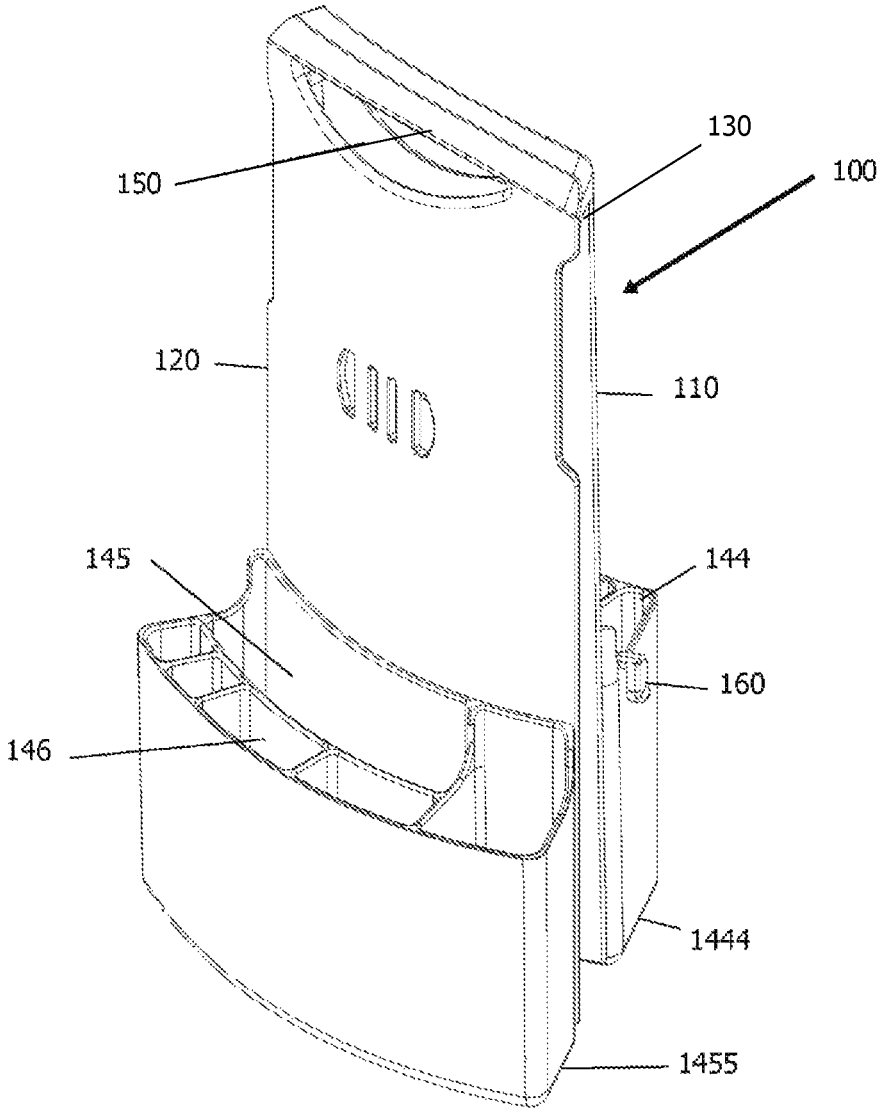
FIG. 2 is an isometric view of the modular tool holder

In FIGS. 1 and 2, tool holder or caddy 100 of hard plastic material is shaped to slip over and securely fit on rim 55 of common plastic bucket 50. The tool holder has exterior support section 120 that conforms to the shape of the bucket's exterior wall and interior support section 110 that conforms to the shape of the bucket's interior wall. Tool holder 100 has saddle 130 formed to match the bucket's radius and taper at the rim of the bucket. The upper inside part of saddle 130 rests on the bucket's rim, supporting the tool holder.

Compartments 141 et seq. that attach to the tool holder's exterior provide space for holding and organizing tools. Compartment shapes may take a wide range of shapes and embodiments, as illustrated in the drawings and may be optimized for specific tasks, such as carrying larger tools or carrying small parts. Handle 150, one of many possible handle embodiments, is used to lift tool holder 100 on and off the bucket. Tool holder's underside has a generally flat bottom 1455 or 1444 to permit a stable freestanding tool holder when it is used independent of the bucket.

Compartment 148 is meant generally to illustrate the embodiment of external support section 120 where the compartments are either integral to the support section, or permanently attached to it. Compartment 149 is meant generally to illustrate the embodiment of external support section 120 where the compartments are removably attached to the support section, for instance by means of tabs and guides 126.

Figure 9:
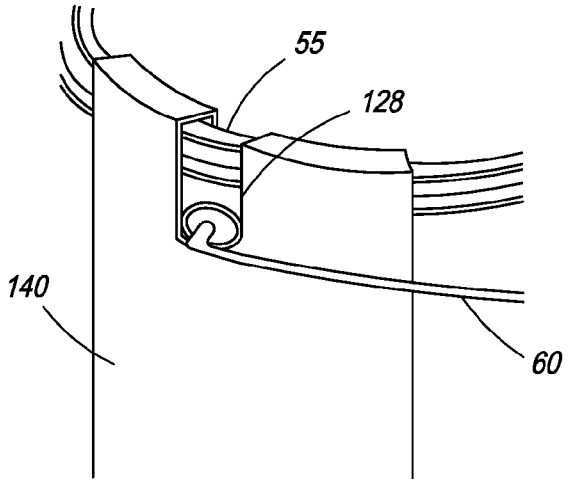
FIG. 9 is a schematic isometric view of a detail of the tool holder

A clip or similar attachment device 160 is used to secure the tool holders to each other on a bucket. Paired cutouts 121, 123 permit two tool holders to abut each other on each side of a bucket's handle. In FIG. 9, an alternative cutout 128 in the tool holder divides compartments 140 and extends into the saddle cutout to permit the device to slip over bucket handle 60 when the handle is raised in the upright position and come to rest on bucket rim 55.

Figure 3:
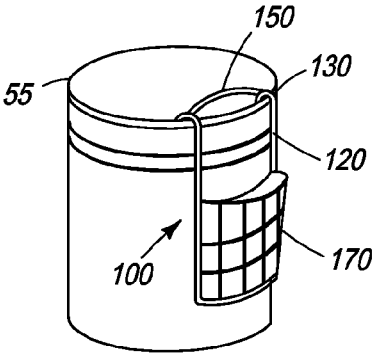
FIG. 3 is an isometric view of an alternate modular tool holder
Figure 4:
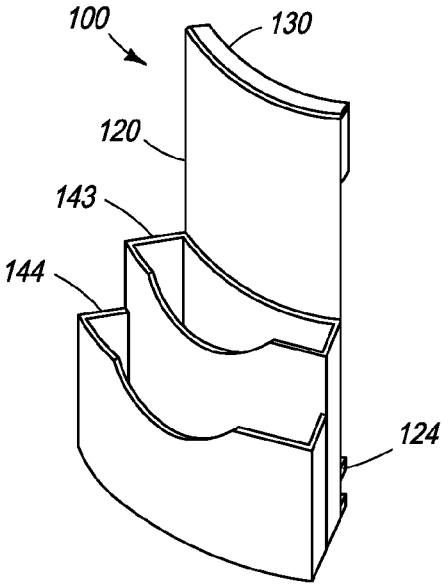
FIG. 4 is an isometric view of an alternate modular tool holder
Figure 5:
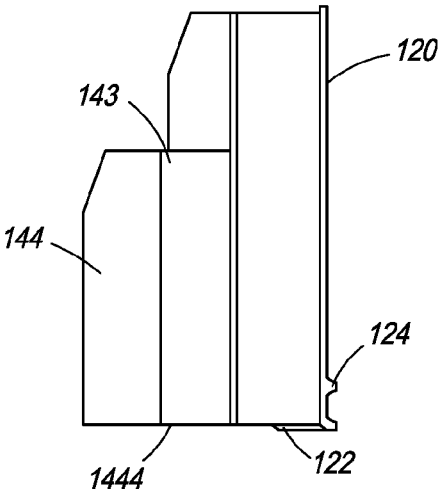
FIG. 5 is a partial schematic side elevation of a detail of the tool holder

FIGS. 3, 4 and 5 show alternate embodiments of tool holder or caddy 100. External support section 120 is made of wire of metal in dimensions that will readily occur to those skilled in the art. Like kind wire also makes up basket compartment 170 and handle 150 and saddle 130. Saddle 130 is hooked over rim 55 of bucket 50, and may optionally have a like kind wire made internal support section inside the bucket (not shown). In FIG. 4 single section tool holder 100 has only external section 120 (no internal section to speak of) to which compartments 143 and 144 are attached. Saddle 130 is provided to engage the tool holder with the bucket rim (not shown).

FIG. 5 is a detail of external support section 120 showing generally flat bottom 1444 of compartment 144. To provide equal length sections for independent standing, when the sections are not of equal length at the bottoms of their bottom-most compartments, stand-off or foot 122 is provided to equalize any height or length difference. Guide 124 is optionally provided to fill the space between the inside of external support section 120 and the lower outside of the container or bucket, when the taper of the support section is not an exact match for the taper of the bucket.

Figure 6:
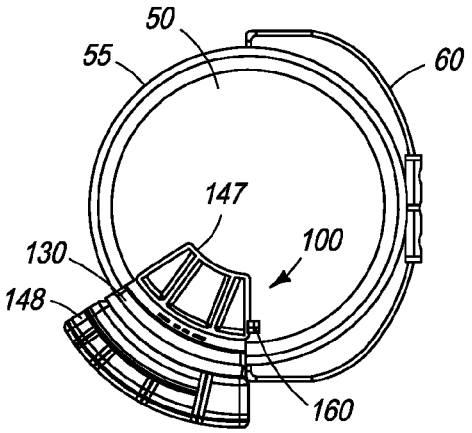
FIG. 6 is a plan view of the modular tool holder with container

FIG. 6 shows bucket 50 with rim 55 and handle 60 supporting at its saddle 130 tool holder 100. The tool holder has compartment set 148 on its external support section and compartment set 147 on its internal support section, and clip 160 protruding from compartment set 147 to mate or attach to another tool holder, as needed.

Figure 7:
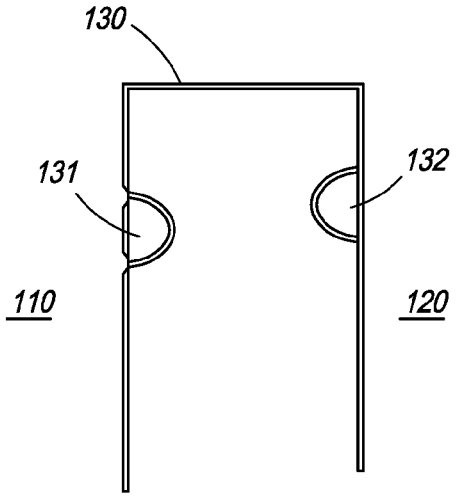
FIG. 7 is a schematic cross section of a detail of the tool holder
Figure 8:
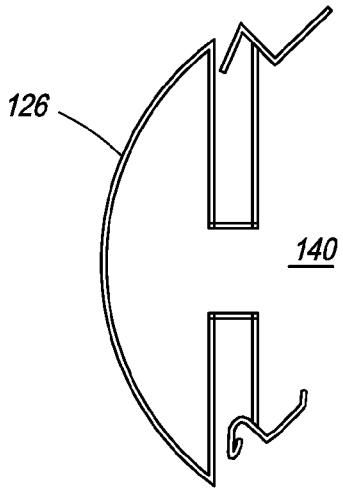
FIG. 8 is a schematic side view of a detail of the tool holder

FIGS. 7 and 8 show details of aspects of saddle 130 and removable compartment 140, respectively. Inside saddle 130 there is a guide or catch 132 on its exterior side that will mate with exterior support section 120, and guide or friction spacer or pad 131 on its interior side that will mate with interior support section 110. Generally, guide 132 is sized and positioned to catch and releasably hold the outwardly protruding lip of bucket rim 55, a lip common to most such buckets. Generally, guide 131 is sized and of a material to provide some degree of friction between the interior saddle wall and the exterior wall of the bucket just below the rim. For example, a small, thin rubber pad with a sticky backing (the kind people sometimes use on a lamp base to prevent marring of furniture) holds the units in place. The pad is placed on the inside of the interior saddle because the rim is smooth on the inside (not jutting out like on the exterior). The pad facilitates solid purchase with greater surface area. The guide or set of points extending into the interior of the saddle can also take the form of small bumps or radiuses that also create friction at the top of the saddle.

In FIG. 8 a nominal compartment 140 has a tab 126 that slips through a mating slot on one of the support sections to which it is to be removably attached. When serving only as such a tab it can be most any shape and need have only one hook, not two. The illustration is also intended to show the rounded shape of the tab when it is also a guide for the tool holder's easy installation on and removal from the bucket.

When the tool holder is on the bucket, it fits snugly enough to the bucket to remain securely in place yet not so snug that it is difficult to remove from the bucket or to reattach it. The tool holder is an economical device made from an extremely durable medium that can extend the use of bucket tool holders for tasks and activities for which they are currently not optimized. It provides convenient space for holding, storing, and accessing tools, is easy to take on and off a bucket to permit use of the device with or without a bucket, and is comfortable to carry.

Alternative embodiments for the modular tool holder include:

a tool holder formed in various sizes and that extend inward, inside the bucket, up to half the radius of a common bucket;

use of four tool holders, as shown in FIG. 1;

any number of tool holders from one to six or more may be used and the tool holders may, if desired, cover the complete rim of a bucket and entire bottom of the bucket to maximize space for tools;

a tool holder may omit the interior compartment and much of the interior support section, as shown in FIG. 9, to permit use of the interior of the bucket for holding water, potting soil, mixing compounds, or many other materials;

a tool holder may include various cutouts on its exterior and interior sections to hold Velcro bands and other types of strapping material for supporting tools;

a tool holder may be covered or partially covered by fabric or other material to enhance decorative aspects of the device or to provide a mixture of hard plastic compartments and more flexible fabric compartments if desired;

a tool holder may incorporate the use of a lid or lids for its compartments to help retain tools, hardware, and small parts; and a tool holder may include stackable tool compartments that sit on, slide on, or otherwise attach to it, to provide additional tool storage space.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

We claim:

1. A tool caddy for an open container, the container having a depth, the container also having a rim with at least one flange, and the container also having tapering walls, such that a radius at the interior of the rim of the container is greater than a radius at the interior of a base of the container, the caddy comprising generally vertical inner and outer compartment support sections, at least the inner support section having vertical height generally commensurate with the container depth, the inner and outer sections each comprised of hard plastic, semi-flexible material and joined to each other at their respective upper ends by a hard plastic, semi-flexible saddle, such that the inner and outer sections can be flexed away from each other to slide over the at least one flange of the container rim and return to their approximate non-flexed shape, wherein at least the inner support section is pre-formed at an angle which fits the tapering walls of the container.

2. The tool caddy of claim 1 further comprising a plurality of compartments removably attached to at least one of the support sections.

3. The tool caddy of claim 1 wherein the saddle further comprises at least one guide extending into an interior of the saddle to engage the at least one flange of the container rim.

4. The tool caddy of claim 3 wherein the at least one guide further comprises a guide chosen from the set of guides consisting of a ridge, a point and a set of points.

5. The tool caddy of claim 2 wherein each compartment has at least one tab and is removably attached to its section by hooking into a slot in the section.

6. The tool caddy of claim 2 wherein at least one compartment has a generally flat bottom and is operatively engaged at a lower end of a support section so that the flat bottom comprises a base for the caddy to stand alone.

7. The tool caddy of claim 6 wherein both support sections each have a base and one of the bases has a stand-off.

8. A bucket and at least one tool caddy for the bucket, the bucket having a rim with at least one flange, the bucket also having tapering walls such that a radius at the interior of the rim of the bucket is greater than a radius at the interior of base of the bucket, the tool caddy comprising generally vertical inner and outer compartment support sections, at least the inner support section having a vertical height generally commensurate with a bucket depth, the inner and outer sections each comprised of hard plastic, semi-flexible material and joined to each other at their respective upper ends by a hard plastic, semi-flexible saddle, such that the inner and outer sections can be flexed away from each other to slide over the at least one flange of the bucket rim and return to their approximate non-flexed shape, the inner support section further comprising at least one compartment that is disposed on a bottom portion of the inner support, leaving the bucket generally open at the top, wherein the inner and outer sections are pre-formed at angles which fit the tapering walls of the bucket.

9. The bucket and caddy of claim 8 further comprising a plurality of side-by-side tool caddies on the bucket.

10. The bucket and caddy of claim 9 further comprising a section fastener to attach respective side-by-side caddies to one another, the fastener selected from the group of fasteners consisting of: clip, clasp, slide and pin.

11. The bucket and caddy of claim 9 further comprising, the bucket having a handle, and, for a pair of caddies, corresponding cutaways that are formed to match the bucket's radii and taper and that are disposed to face each other on each side of an attachment site of the bucket's handle.

12. The bucket and caddy of claim 8 further comprising a plurality of compartments removably attached to at least one of the support sections, and further wherein the at least one tool caddy is removable from the bucket to stand generally vertically on its own.

13. The bucket and caddy of claim 8 wherein the saddle further comprises a built in handle.

14. A tool caddy for an open container having a depth, the container also having a rim with at least one flange, and the container also having tapering walls, such that a radius at the interior of the rim of the container is greater than a radius at the interior of a base of the container, the caddy comprising generally vertical inner and outer compartment support sections, at least the inner support section having a vertical height generally commensurate with the container depth, the inner and outer sections each comprised of hard plastic, semi-flexible material and joined to each other at their respective upper ends by a hard plastic, semi-flexible saddle, such that the inner and outer sections can be flexed away from each other to slide over the at least one flange of the container rim and return to their approximate non-flexed shape, wherein at least the inner support section is pre-formed at an angle which fits the tapering walls of the container, the inner support section further comprising at least one compartment that is disposed near the bottom of the container, and the caddy, which comprises the support sections and the saddle, is configured and disposed, to stand rigidly and vertically on its own.

15. The tool caddy of claim 1 wherein the saddle further comprises a handle configured to facilitate lifting the caddy.

16. The tool caddy of claim 1 wherein the inner support section further comprises at least one compartment that is disposed near the bottom of the container.

17. The tool caddy of claim 1 wherein the container, for which the caddy is configured, also has a rigid handle, and the outer support section is configured to rigidly fit around a portion of an attachment site of the container's handle.

* * * * *